US008028352B1

(12) United States Patent
Heman

(10) Patent No.: US 8,028,352 B1
(45) Date of Patent: Oct. 4, 2011

(54) POOL COVERING APPARATUS

(76) Inventor: Darrin L. Heman, Creighton, MO (US)

( * ) Notice: Subject to any disclaimer, the term of this patent is extended or adjusted under 35 U.S.C. 154(b) by 1001 days.

(21) Appl. No.: 11/935,492

(22) Filed: Nov. 6, 2007

(51) Int. Cl.
*E04H 4/00* (2006.01)

(52) U.S. Cl. ..... 4/498

(58) Field of Classification Search ..... 4/498–500, 4/503

See application file for complete search history.

(56) References Cited

U.S. PATENT DOCUMENTS 3,461,890 A 8/1969 Goodrich
3,469,587 A 9/1969 Folkes
3,533,110 A * 10/1970 Gisondi ..... 4/499
3,534,412 A 10/1970 Crook
3,683,427 A 8/1972 Burkholz et al.
3,747,131 A * 7/1973 Koliomichalis ..... 4/499
3,855,643 A 12/1974 Sanford et al.
3,970,096 A 7/1976 Nicolai
4,048,678 A 9/1977 Chillino
4,257,132 A 3/1981 Kerby
4,847,925 A * 7/1989 Perry ..... 4/499
D344,805 S 3/1994 Jones
5,970,531 A 10/1999 Demby

* cited by examiner

*Primary Examiner* — Huyen Le

(57) ABSTRACT

A pool covering apparatus includes a tube that forms a continuous loop. The tube is positionable around a perimeter edge of the pool. A flexible panel is attached to the tube and covers an area bounded by the tube. The panel covers the pool when the tube is positioned around the pool. The panel has an area dimension greater than an area dimension bounded by the tube. A lift assembly is attached to the tube and the panel. The lift assembly lifts the cover above a plane of the tube.

10 Claims, 5 Drawing Sheets

POOL COVERING APPARATUS

BACKGROUND OF THE INVENTION

Field of the Invention

The present invention relates to pool cover devices and more particularly pertains to a new pool cover device for covering a pool in such a manner that the pool is protected from debris and weather elements.

SUMMARY OF THE INVENTION

The present invention meets the objectives presented above by generally comprising a tube that forms a continuous loop. The tube is positionable around a perimeter edge of the pool. A flexible panel is attached to the tube and covers an area bounded by the tube. The panel covers the pool when the tube is positioned around the pool. The panel has an area dimension greater than an area dimension bounded by the tube. A lift assembly is attached to the tube and the panel. The lift assembly lifts the cover above a plane of the tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
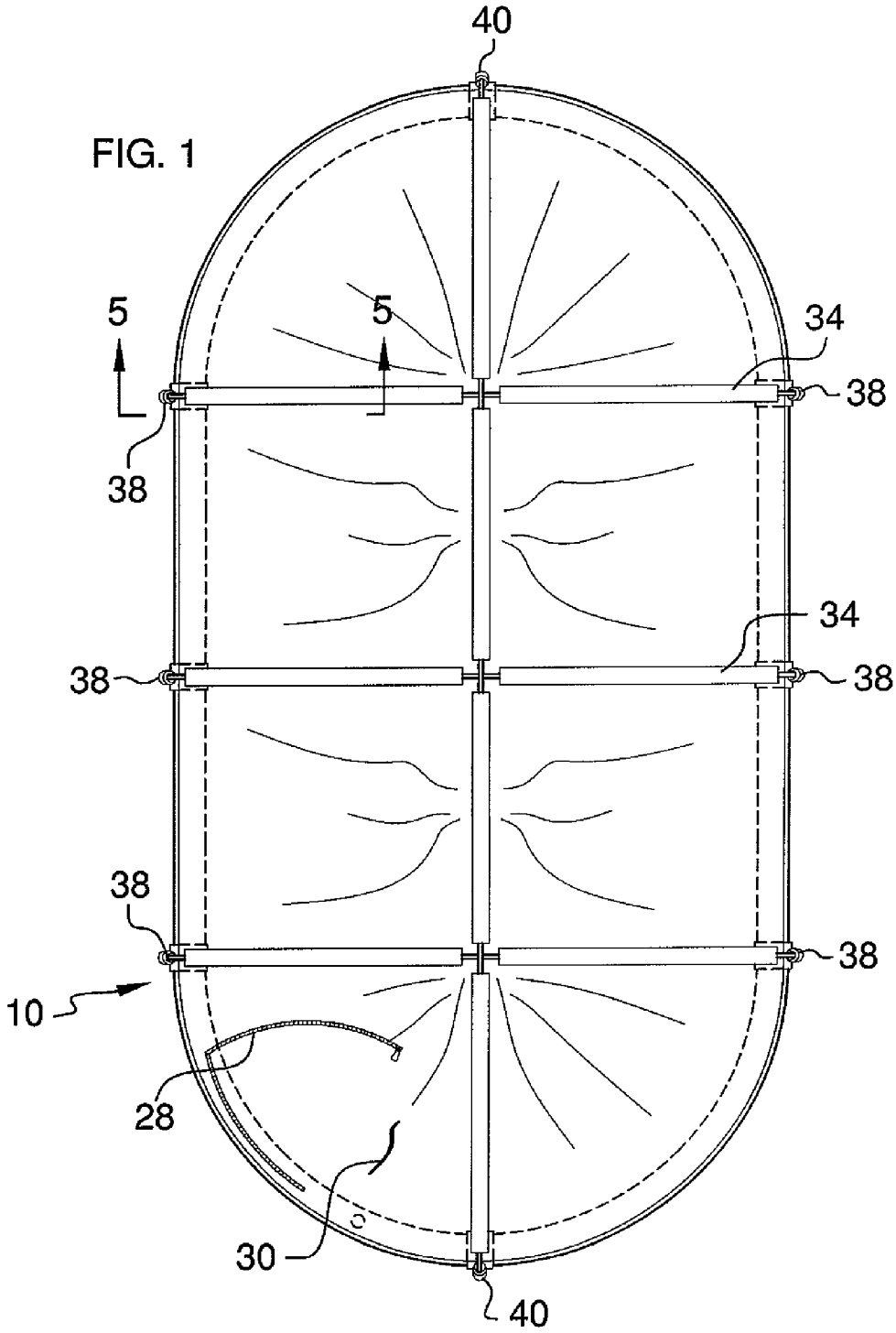
FIG. 1 is a top view of a pool covering apparatus according to the present invention.
Figure 2:
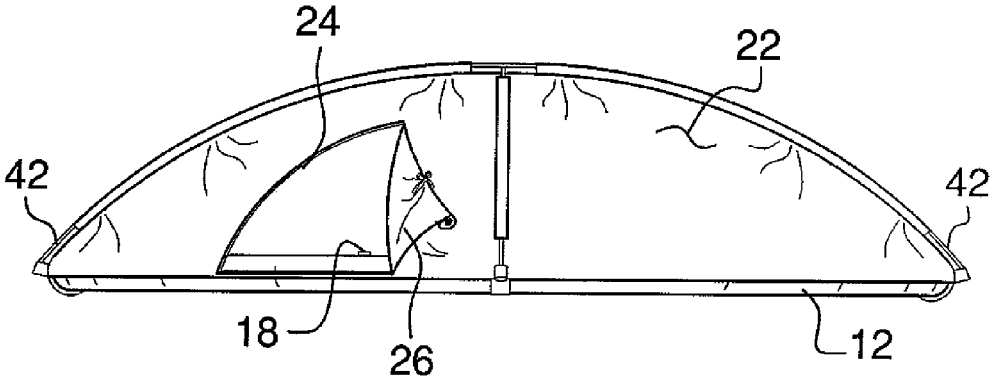
FIG. 2 is a front view of the present invention.
Figure 5:
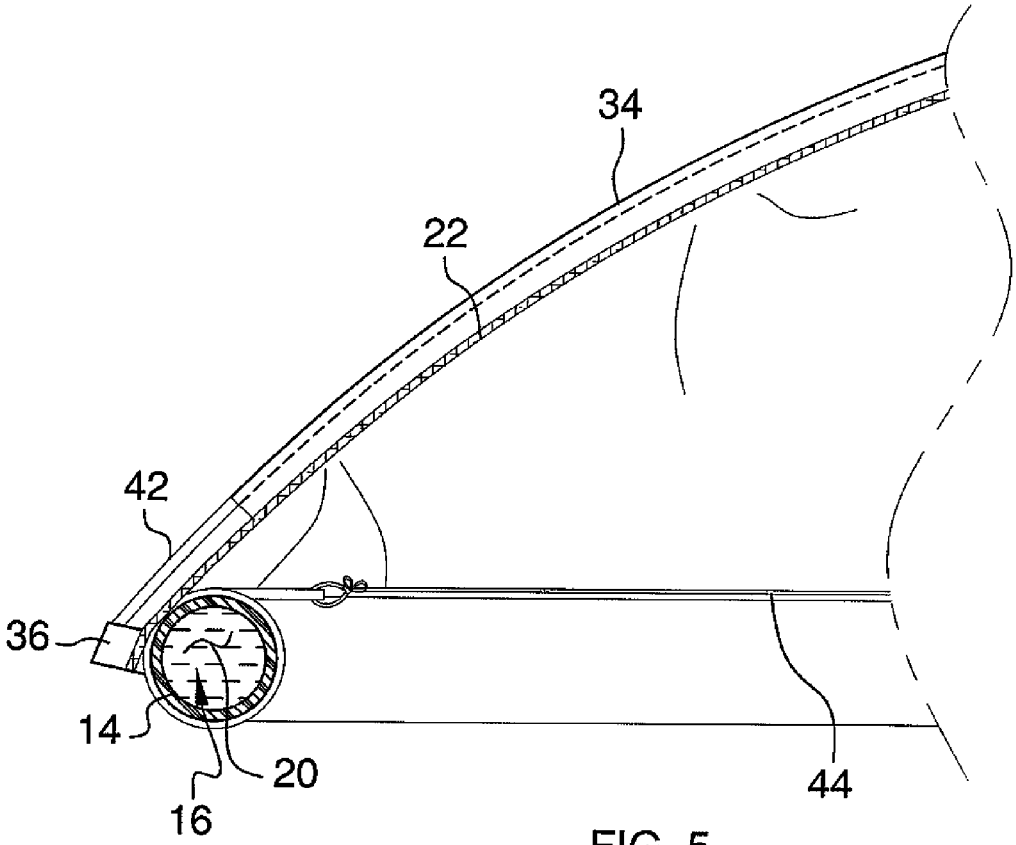
FIG. 5 is a cross-sectional view taken along line 5-5 of FIG. 1 of the present invention.
Figure 3:
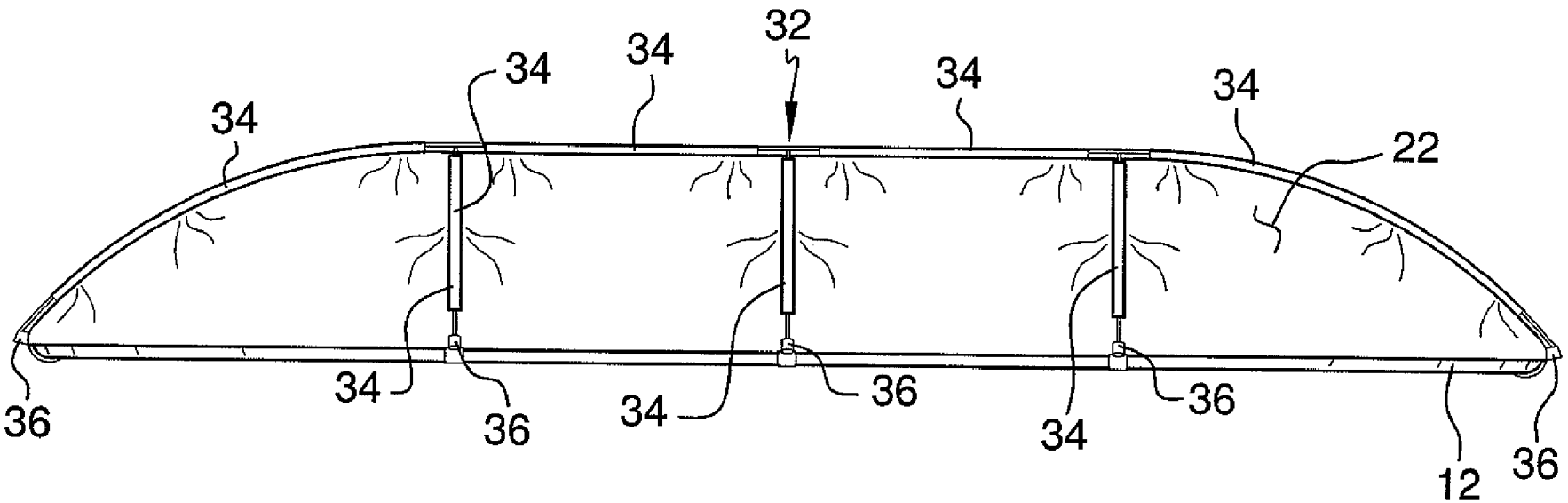
FIG. 3 is a side view of the present invention.
Figure 4:
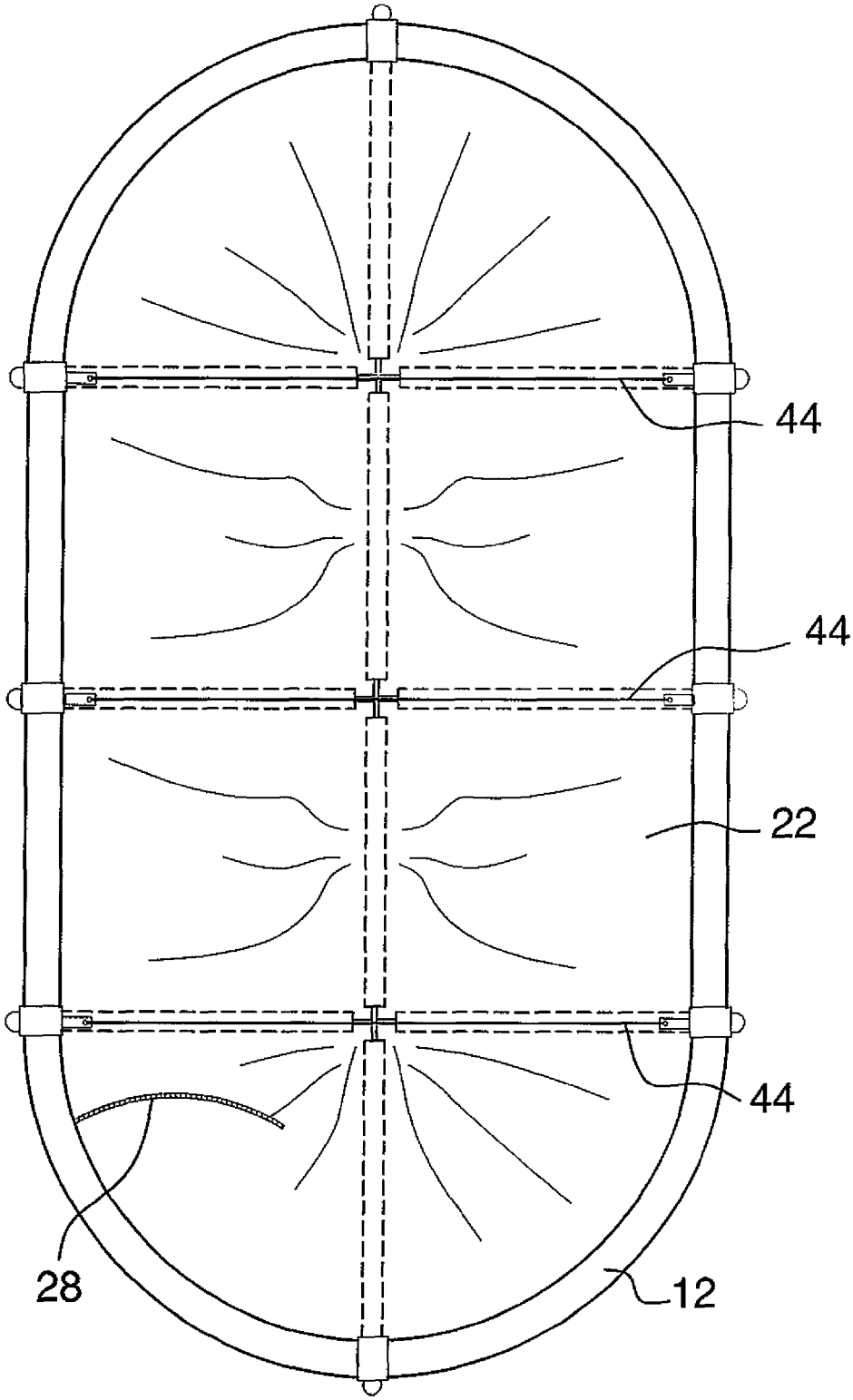
FIG. 4 is a bottom view of the present invention.

With reference now to the drawings, and in particular to FIGS. 1 through 6 thereof, a new pool cover device embodying the principles and concepts of the present invention and generally designated by the reference numeral 10 will be described.

As best illustrated in FIGS. 1 through 6, the pool 8 covering apparatus 10 generally comprises a tube 12 that forms a continuous loop and has a peripheral wall 14 encompassing an internal space 16. The tube 12 is flexible. A fill conduit 18 is fluidly coupled to the tube 12. A liquid 20, such as water, is inserted though the fill conduit 18 to fill the tube 12 with the liquid. The tube 12 is positionable around a perimeter edge of the pool 8.

A flexible panel 22 is attached to the tube 12 and covers an area bounded by the tube 12. The panel 22 covers the pool 8 when the tube 12 is positioned around the pool 8. The panel 22 has an area dimension greater than an area dimension bounded by the tube 12 to allow slack to be formed in the panel 22. The panel 22 has an access opening 24 therein closable with a flap 26. A closure 28 is positioned on the panel 22 to selectively secure the flap 26 in a closed position. The closure 28 is a zipper and a tie strap 30 may be used to secure the flap 26 in an open position.

A lift assembly 32 is attached to the tube 12 and the panel 22. The lift assembly 32 lifts the cover 22 above a plane of the tube 12 and thereby lifts the cover upwardly away from the pool 8. The lift assembly 32 includes a plurality of sleeves 34 that are attached to an upper surface of the panel 22. The sleeves 34 are spaced from each other. A plurality of receiving members 36 is attached to the tube 12. The receiving members 36 include a plurality of pairs of oppositely positioned receiving members 36. The receiving members at least includes a first pair of receiving members 38 and a second pair of receiving members 40. A line extending between the first pair of receiving members 38 is oriented perpendicular to a line extending between the second pair of the receiving members 40. The pairs of receiving members 36 may include a plurality of first pairs of receiving members 38 that are aligned with each other and oriented perpendicular to the second pair of receiving members 40. The sleeves 34 are positioned to include pairs of aligned sleeves 34 wherein each of the pairs of aligned sleeves 34 is aligned with one the pairs of receiving members 36.

The lift assembly 32 also includes a plurality of flexible elongated members 42. Each of the flexible elongated members 42 extends between and is extended into oppositely positioned ones of the receiving members 36 to form an arch over the area bounded by the tube 12. The elongated members 42 each extend through at least one of the sleeves 34 to support the panel 22 upwardly over the pool 8.

A plurality of tethers 44 is also provided. Each of the tethers 44 is attached to the tube 12 and traverses the area bound by the tube 12. The tethers 44 have a selectively adjustable length to alter a shape of the area bounded by the tube 12 as shown in FIG. 6.

Figure 6:
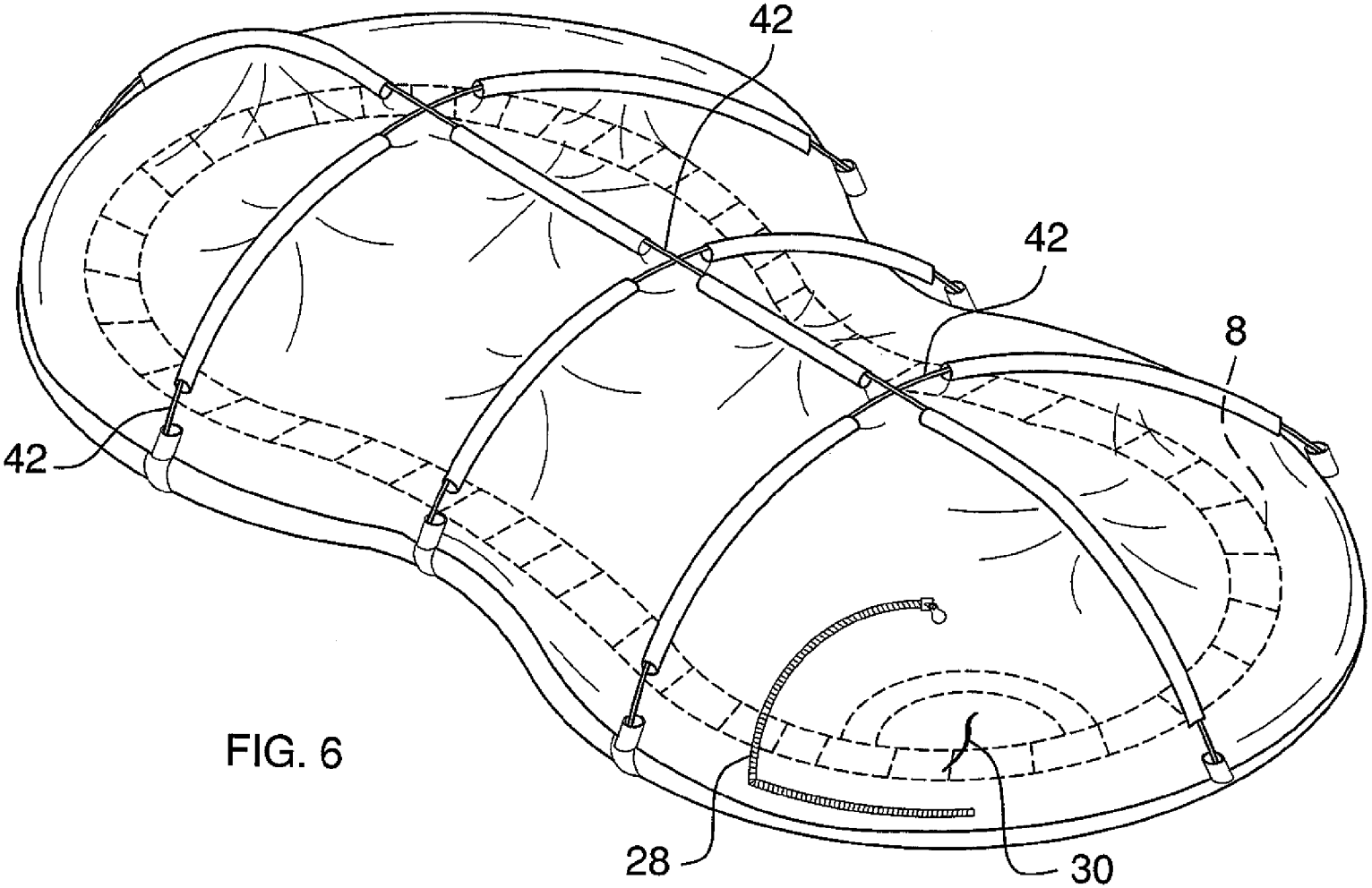
FIG. 6 is a perspective view of the present invention.

In use, the tube 12 is positioned around a pool 8 as shown in FIG. 6. The tube 12 is then filled with water, such as from a hose, to provide weight to the tube 12 to prevent its movement. This also allows for draining of the tube 12 for easy transportation and storage thereof. The tethers 44 may be used as need to match the tube 12 to the contours of the pool 8. The elongated members 42 are then coupled to the panel 22 with the sleeves 34 and attached to the tube 12 with the receiving members 36 to lift the panel 22 above the pool 8. The access opening 24 allows access to the pool 8 so that it may be used while the panel 22 covers the pool 8. While positioned on the pool 8, the apparatus 10 prevents dirt and leaves from entering the pool 8 as well as protecting the pool 8 from inclement weather to assist in retaining the pool 8 at a warm temperature.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pool cover apparatus being removably positionable over and covering a pool, said apparatus comprising:

a tube forming a continuous loop, said tube being positionable around a perimeter edge of the pool;

a flexible panel being attached to said tube and covering an area bounded by said tube, said panel covering the pool when said tube is positioned around the pool, said panel having an area dimension greater than an area dimension bounded by said tube; and a lift assembly being attached to said tube and said panel, said lift assembly lifting said cover above a plane of said tube, said lift assembly including:

a plurality of sleeves being attached to an upper surface of said panel, said sleeves being spaced from each other;

a plurality of receiving members being attached to said tube, said receiving members including a plurality of pairs of oppositely positioned receiving members; and a plurality of flexible elongated members, each of said flexible elongated members extending between and being extended into oppositely positioned ones of said receiving members to form an arch over the area bounded by said tube, said elongated members each extending through at least one of said sleeves to support said panel.

2. The apparatus according to claim 1, wherein said tube is flexible, a fill conduit being fluidly coupled to said tube, a liquid being inserted though said fill conduit to fill said tube with said liquid.

3. The apparatus according to claim 1, wherein said panel has an access opening therein, a flap is positionable over the access opening, a closure being positioned on said panel to selectively secure said flap in a closed position.

4. The apparatus according to claim 1, wherein said receiving members at least includes a first pair of receiving members and a second pair of receiving members, a line extending between said first pair of receiving members being oriented perpendicular to a line extending between said second pair of said receiving members.

5. The apparatus according to claim 1, further including a plurality of tethers, each of said tethers being attached to said tube and traversing the area bound by said tube, said tethers having a selectively adjustable length to alter a shape of the area bounded by said tube.

6. The apparatus according to claim 1, further including a plurality of tethers, each of said tethers being attached to said tube and traversing the area bound by said tube, said tethers having a selectively adjustable length to alter a shape of the area bounded by said tube.

7. A pool cover apparatus being removably positionable over and covering a pool, said apparatus comprising:

a tube forming a continuous loop and having a peripheral wall encompassing an internal space, said tube being flexible, a fill conduit being fluidly coupled to said tube, a liquid being inserted though said fill conduit to fill said tube with said liquid, said tube being positionable around a perimeter edge of the pool;

a flexible panel being attached to said tube and covering an area bounded by said tube, said panel covering the pool when said tube is positioned around the pool, said panel having an area dimension greater than an area dimension bounded by said tube, said panel having an access opening therein, a flap is positionable over the access opening, a closure being positioned on said panel to selectively secure said flap in a closed position;

a lift assembly being attached to said tube and said panel, said lift assembly lifting said cover above a plane of said tube, said lift assembly including;

a plurality of sleeves being attached to an upper surface of said panel, said sleeves being spaced from each other;

a plurality of receiving members being attached to said tube, said receiving members including a plurality of pairs of oppositely positioned receiving members, said receiving members at least including a first pair of receiving members and a second pair of receiving members, a line extending between said first pair of receiving members being oriented perpendicular to a line extending between said second pair of said receiving members;

a plurality of flexible elongated members, each of said flexible elongated members extending between and being extended into oppositely positioned ones of said receiving members to form an arch over the area bounded by said tube, said elongated members each extending through at least one of said sleeves to support said panel; and a plurality of tethers, each of said tethers being attached to said tube and traversing the area bound by said tube, said tethers having a selectively adjustable length to alter a shape of the area bounded by said tube.

8. A pool cover apparatus being removably positionable over and covering a pool, said apparatus comprising:

a tube forming a continuous loop, said tube being positionable around a perimeter edge of the pool;

a flexible panel being attached to said tube and covering an area bounded by said tube, said panel covering the pool when said tube is positioned around the pool, said panel having an area dimension greater than an area dimension bounded by said tube;

a lift assembly being attached to said tube and said panel, said lift assembly lifting said cover above a plane of said tube; and a plurality of tethers, each of said tethers being attached to said tube and traversing the area bound by said tube, said tethers having a selectively adjustable length to alter a shape of the area bounded by said tube.

9. The apparatus according to claim 8, wherein said tube is flexible, a fill conduit being fluidly coupled to said tube, a liquid being inserted though said fill conduit to fill said tube with said liquid.

10. The apparatus according to claim 8, wherein said panel has an access opening therein, a flap is positionable over the access opening, a closure being positioned on said panel to selectively secure said flap in a closed position.

* * * * *